US010366801B2

(12) United States Patent
Imbert

(10) Patent No.: US 10,366,801 B2
(45) Date of Patent: Jul. 30, 2019

(54) ELECTRIC CURRENT TRANSMISSION CABLE AND METHOD OF FABRICATING SUCH A CABLE

(71) Applicant: RTE RESEAU DE TRANSPORT D'ELECTRICITE, Paris, La Defense (FR)

(72) Inventor: Serge Imbert, Carrieres-sous-Poissy (FR)

(73) Assignee: RTE RESEAU DE TRANSPORT D'ELECTRICITE, Le Defense (FR)

( * ) Notice: Subject to any disclaimer, the term of this patent is extended or adjusted under 35 U.S.C. 154(b) by 6 days.

(21) Appl. No.: 15/570,531

(22) PCT Filed: Apr. 26, 2016

(86) PCT No.: PCT/FR2016/050973
§ 371 (c)(1),
(2) Date: Oct. 30, 2017

(87) PCT Pub. No.: WO2016/174339
PCT Pub. Date: Nov. 3, 2016

(65) Prior Publication Data

US 2018/0151267 A1 May 31, 2018

(30) Foreign Application Priority Data

Apr. 30, 2015 (FR) ..... 15 53954

(51) Int. Cl.
*H01B 1/02* (2006.01)
*C23C 8/62* (2006.01)
(Continued)

(52) U.S. Cl.
CPC ..... *H01B 1/023* (2013.01); *B24C 3/322* (2013.01); *C23C 8/62* (2013.01); *H01B 1/08* (2013.01); *H01B 5/004* (2013.01); *B24C 1/00* (2013.01)

(58) Field of Classification Search
CPC combination set(s) only.
See application file for complete search history.

(56) References Cited

U.S. PATENT DOCUMENTS 4,759,805 A * 7/1988 Saruwatari ..... C23C 8/16 148/275
2001/0056224 A1* 12/2001 Renner ..... A61B 1/00075 600/139

FOREIGN PATENT DOCUMENTS

FR 2 874 282 A1 2/2006
FR 2 874 283 A1 2/2006
(Continued)

OTHER PUBLICATIONS

U. Straumann et al.: "Potential reduction of audible noise from new and aged overhead transmission line conductors by increasing their hydrophilicity", Cigre 2010, pp. 1-9, XP055259014, B2-113, 21, rue d'Artois, F-75008 Paris.
(Continued)

*Primary Examiner* — William H. Mayo, III
*Assistant Examiner* — Krystal Robinson
(74) *Attorney, Agent, or Firm* — Young & Thompson

(57) ABSTRACT

This electric current transmission cable includes a non-anodized bare conductor based on aluminum or an aluminum alloy having a hydrophilic external specific surface intended to be in contact with the atmospheric environment, and an inside volume intended to conduct an electric current. The external specific surface of the bare conductor has a first roughness parameter, defined as the arithmetic mean deviation, measurable by profilometry, of peaks and valleys in
(Continued)

comparison to a predetermined average profile over a reference length or surface, equal to or greater than 1.9 μm. In addition, the inside volume of the bare conductor has oxygen doping of its aluminum-based or aluminum alloy-based components at a ratio equal to or greater than 20%, to a depth of at least 300 nm with respect to the external specific surface.

20 Claims, 4 Drawing Sheets

(51) Int. Cl.

| | |
|---|---|
| ***H01B 5/00*** | (2006.01) |
| ***B24C 3/32*** | (2006.01) |
| ***H01B 1/08*** | (2006.01) |
| *B24C 1/00* | (2006.01) |

(56) References Cited

FOREIGN PATENT DOCUMENTS

| | | |
|---|---|---|
| FR | 2 990 047 A1 | 11/2013 |
| JP | H0997519 A | 4/1997 |

OTHER PUBLICATIONS

International Search Report, dated Jul. 12, 2016, from corresponding PCT/FR2016/050973 application.

* cited by examiner

ELECTRIC CURRENT TRANSMISSION CABLE AND METHOD OF FABRICATING SUCH A CABLE

BACKGROUND OF THE INVENTION

Field of the Invention

The present invention refers to an electric current transmission cable. It also refers to a method for manufacturing such a cable.

Description of the Related Art

It applies in particular, but not exclusively, to the overhead transport of HTB high-voltage electric current as defined in French Standard NF C18-510. According to that standard, type HTB high voltage is defined as strictly greater than 50 kV for alternating current and strictly greater than 75 KV for direct current. In particular, the HTB2 voltage range defined for voltages of 130 to 350 kV of alternating current, and the HTB3 voltage range defined for voltages of 350 to 500 kV, are concerned by the potential applications of the invention.

Overhead high-voltage alternating current transmission lines generally consist of cables of bare single-strand or multiple-strand conductors made of aluminum or aluminum alloy, installed on pylons and kept above a certain minimum height for safety reasons linked to with high potential gradients, particularly greater than 10 kV/cm.

A surface electric field appears on the surface of the conductors if the structure is under power. When this electric field is locally sufficiently strong, particularly greater than the ionization field of moist air, on the order of 10 kV/cm, or even greater than the ionization field of dry air, on the order of 30 kV/cm, the air ionizes and produces an electric discharge associated with a characteristic noise; this phenomenon is called the corona effect. This effect becomes more marked as the local curvature radii on the external surface of conductors and the hydrophilicity of such an external surface get smaller.

The problem of the corona effect is that the resulting noise is a nuisance for the neighborhood, particularly in wet weather during which it is especially intense. In addition, it is accompanied by a loss of energy reducing the efficiency of overhead lines and can furthermore present health risks associated with electromagnetic radiation.

Also, raising cable pylons, putting cables underground, moving structures away from potential neighbors, not exceeding a predetermined surface potential gradient, or other measures are costly or unrealistic solutions.

Consequently, a range of solutions generally explored to reduce the corona effect consists in increasing the cross-section of a bare conductor to reduce the effect of the surface electric field, such as by increasing the number of strands in the conductor, increasing their cross-section, or separating the conductor into several bundles. But this generally leads either to excess weight and wind load on the cable, which may be unacceptable, or an insufficient reduction of the corona effect.

Another range of solutions consists in covering the bare conductor, at least partially, for example by means of a semiconductor polymer sheath as described in patent FR 2 990 047 B1, by means of a hydrophilic plastic sheath as described in patent FR 2 874 282 B1, by means of an absorbent textile covering as described in patent FR 2 874 283 B1, or by some other means. These solutions are generally costly and sometimes also result in considerable excess weight as well as greater bulkiness.

It is therefore preferable to keep the bare conductor in direct contact with the atmospheric environment while ensuring that the hydrophilicity of the external specific surface thereof is as satisfactory as possible. The "external specific surface" of a conductor, whether a single-strand or multiple-strand conductor, is understood as the actual surface area of contact between the surface of the conductor and the external atmospheric environment, as contrasted with the apparent cylindrical (in the case of a single strand) or quasi cylindrical (in the case of multiple-strands) surface area thereof.

The invention thus applies more specifically to an electric current transmission cable comprising a non-anodized conductor based on aluminum or an aluminum alloy having a hydrophilic external specific surface intended to be in contact with the atmospheric environment and an inside volume intended to conduct an electric current.

Such a transmission cable is described in the article by Straumann et al., entitled "Potential reduction of audible noise from new and aged overhead transmission line conductors by increasing their hydrophilicity", published by the CIGRE (International Council on Large Electric Systems) in 2010 under reference number B2-113. Indeed, this article presents a non-anodized bare conductor cable with an external specific surface that is treated by blasting with abrasive granules such as glass beads. Such a treatment is shown to increase the roughness and therefore the hydrophilicity of the conductor's external surface. The results in terms of reduced corona effect, however, leave room for improvement, as such results are not sufficient. Specifically, the increase in roughness using the fabrication process described in that document is limited.

It may therefore be desirable to design an electric current transmission cable which can overcome at least some of the aforementioned problems and limitations.

BRIEF SUMMARY OF THE INVENTION

The invention therefore proposes an electric current transmission cable comprising a non-anodized bare conductor based on aluminum or an aluminum alloy having a hydrophilic external specific surface intended to be in contact with the atmospheric environment, and an inside volume intended to conduct an electric current, wherein:

- the external specific surface of the bare conductor has a first roughness parameter, defined as the arithmetic mean deviation, measurable by profilometry, of peaks and valleys in comparison to a predetermined average profile over a reference length or surface, equal to or greater than 1.9 μm; and
- the inside volume of the bare conductor has oxygen doping of its aluminum-based or aluminum alloy-based components at a ratio equal to or greater than 20%, to a depth of at least 300 nm with respect to the external specific surface.

Consequently, by combining a significant increase in the roughness as defined above (bearing in mind that the external roughness of a new cable expressed according to the same parameter is generally on the order of 0.5 μm) with sufficient in-depth aluminum oxide doping of the conductor, it has been observed surprisingly that the corona effect is greatly reduced, namely in proportions markedly greater than those put forth in the aforementioned article by Straumann et al., and this without increasing the weight and cross-section of the cable. This can be explained by the fact that the oxygen doping, which keeps the transported electric current in the inside volume of the conductor so as to reduce the electric field on the surface, in combination with an increased roughness of the external specific surface, causing drops of water to spread over the surface of the conductor in wet weather, thus reducing the point effects and therefore the risk of electric discharge, leads to a technical effect that amplifies the reduction of the corona effect and of the corresponding losses.

Optionally, the first roughness parameter is more precisely within the range [1.9 μm, 25 μm], for example 2.8 μm±0.9 μm.

Also optionally, the inside volume doping varies according to a monotonic decrease in the aluminum oxide ratio from more than 80% to more than 20%, from the external specific surface to said depth of at least 300 nm.

Also optionally, the external specific surface of the bare conductor furthermore has a second roughness parameter, defined as the maximum deviation, measurable by profilometry, between the highest peak and the lowest valley over a reference length or surface, equal to or less than 42 μm.

Also optionally, the second roughness parameter is more precisely within the range [25 μm, 42 μm], for example 35.6 μm±5.9 μm.

Also optionally, the external specific surface of the bare conductor furthermore has a third roughness parameter, defined as the mean squared deviation, measurable by profilometry, of peaks and valleys in comparison to a predetermined average profile over a reference length or surface, equal to or greater than 2.5 μm, especially within the range [2.5 μm, 25 μm], for example equal to 3.6 μm±1.1 μm.

Also optionally, the external specific surface of the bare conductor furthermore has a fourth roughness parameter, defined as the density of peaks, measurable by profilometry, over a reference surface, falling within the range [0.00014/$\mu m^2$, 0.0005/$\mu m^2$].

Also optionally, the external specific surface of the bare conductor furthermore has a fifth roughness parameter, defined as the arithmetic mean of the curvature radii of peaks, said mean being measurable by profilometry over a reference surface area, falling within the range [0.05/μm, 0.35/μm].

Also optionally, the external specific surface of the bare conductor furthermore has a sixth roughness parameter, defined as the Minkowski-Bouligand fractal dimension measurable by profilometry over a reference surface, falling within the range [2.44, 3].

Also optionally, the bare conductor comprises a plurality of aluminum or aluminum alloy strands twisted together in concentric layers of alternating directions around a strand forming the longitudinal axis of the cable, said strands having cross-sections of predetermined shapes such as circular, trapezoidal, or "Z" cross-sections.

Also optionally, the bare conductor is:

made of aluminum, magnesium, and silicon alloy, namely almelec, made of aluminum and zirconium alloy, or made of annealed aluminum.

Also optionally, an electric current transmission cable according to the invention is overhead and is installed on pylons for the transmission of HTB high-voltage electric current, as defined in French standard NF C18-510.

Also a method is proposed for manufacturing an electric current transmission cable comprising a non-anodized bare conductor based on aluminum or an aluminum alloy having a hydrophilic external specific surface intended to be in contact with the atmospheric environment, and an inside volume intended to conduct an electric current, said method comprising a step for blasting abrasive granules against the external specific surface of the bare conductor in which the sand-blasting is conducted with abrasive granules comprising aluminum oxide, so as to:

increase a first roughness parameter of the external specific surface of the bare conductor, said first roughness parameter being defined as the arithmetic mean deviation, measurable by profilometry, of peaks and valleys in comparison to a predetermined average profile over a reference length or surface, up to a value equal to or greater than 1.9 μm; and dope the inside volume of the bare conductor through the adsorption of oxygen atoms coming from the blasted abrasive granules so that said inside volume has an oxygen doping of its aluminum-based or aluminum alloy-based components at a ratio equal to or greater than 20%, to a depth of at least 300 nm with respect to the external specific surface.

Optionally, the sand-blasting is conducted with abrasive granules of corundum.

BRIEF DESCRIPTION OF THE DRAWINGS

The invention will be better understood through the following description provided solely as an example and given in reference to the appended drawings, in which.

DETAILED DESCRIPTION OF THE PREFERRED EMBODIMENTS

Figure 1:
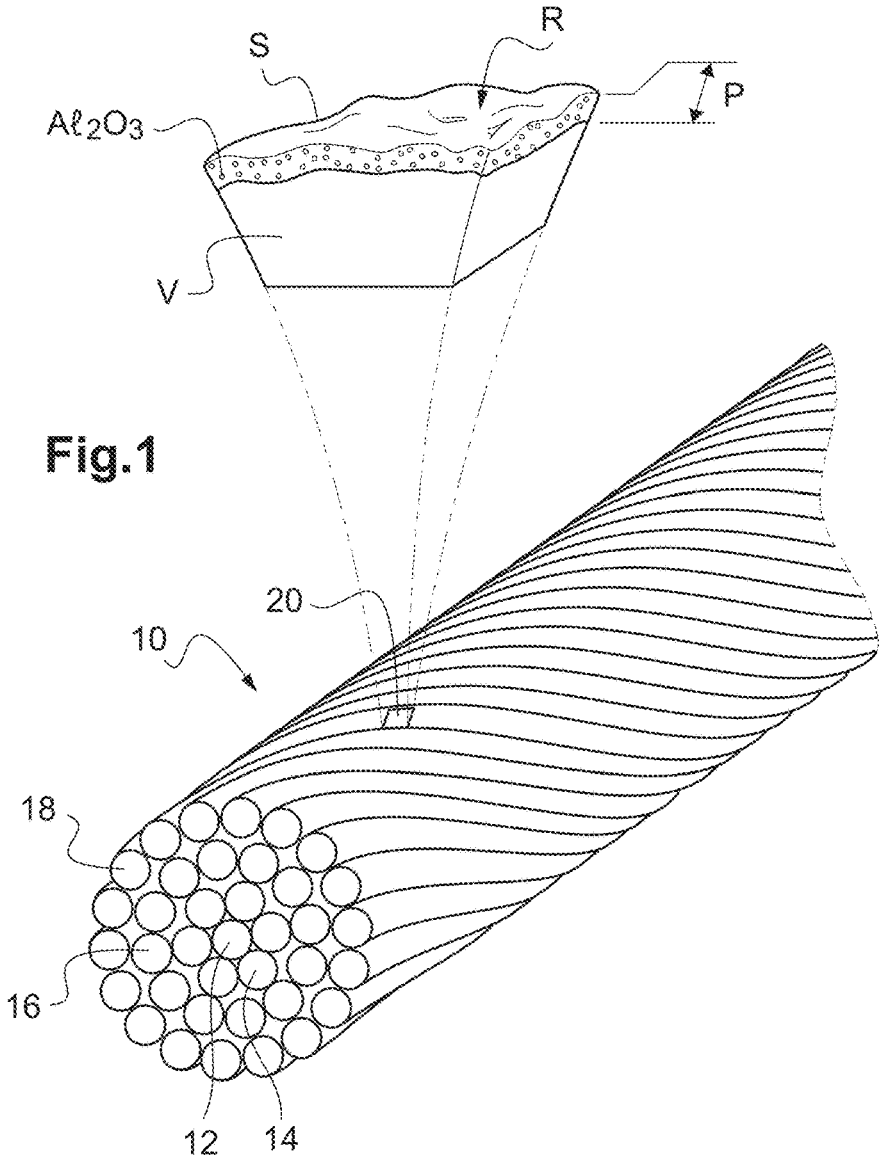
FIG. 1 shows a schematic diagram of a portion of electric current transmission cable with an enlargement of a part of the external specific surface of its conductor, according to an embodiment of the invention.

The portion of cable shown in FIG. 1 consists of bare conductor 10 which in turn consists of a plurality of conductive strands twisted together in concentric layers of alternating directions, said strands having predetermined cross-section shapes such as circular, trapezoidal, or "Z" shaped cross-sections. This structure, which complies with European standards EN 50182, EN 50540, and EN 62219, is the one generally chosen for HTB high voltage electric current transmission cables, which have a diameter of a few centimeters. For example, according to this standard a type 570-AL4 bare conductor has 61 strands made of almelec (aluminum, magnesium, and silicon alloy) with 3.45 mm circular cross-sections arranged in four layers around a central strand for a total diameter of 31.05 mm with a 1% tolerance. Also as an example, which furthermore corresponds to the illustration in FIG. 1, according to this standard a type 288-AL4 bare conductor has 37 strands made of almelec with 2.80 mm circular cross-sections arranged in three layers around a central strand for a total diameter of 19.6 mm with a 1% tolerance. Other configurations and materials based on aluminum, annealed aluminum, or an aluminum alloy (for example, made of almelec or aluminum and zirconium alloy) are also possible according to standards EN 50182, EN 50540, and EN 62219. More specifically, bare conductor 10 type 288-AL4 comprises a central strand 12 forming the longitudinal axis of the cable, a first layer 14 of six strands twisted around the central strand 12, a second layer 16 of twelve strands twisted around the first layer in the opposite direction, and a third layer 18 of eighteen strands twisted around the second layer in the opposite direction.

Strands 12, 14, 16, and 18 are wound in such a way that only a portion of the surface of each strand 18 in the third and last layer is in contact with the atmospheric environment in order to form the external specific surface of bare conductor 10. The rest of strands 12, 14, 16, and 18 forms an inside volume of the cable intended to conduct an electric current.

It should in addition be noted that bare conductor 10 is not anodized. This means that it has not undergone any treatment of its external specific surface for the purpose of covering it with an additional protective and insulating layer by anodic oxidation.

However, an enlargement of a portion 20 of external specific surface S of conductor 10 to a certain depth P of its inside volume V shows that:

- the external specific surface S of conductor 10 has a roughness R of a certain amount, thus giving it a certain hydrophilicity, and
- the inside volume V of conductor 10 has oxygen doping of its aluminum-based or aluminum alloy-based components at a ratio greater than a certain predetermined value, to a depth P with respect to the external specific surface S.

With regard to roughness R, there are a large number of parameters to express it. Some of these parameters are defined by international standards. These include, for example, the following parameters:

- a first roughness parameter defined as the arithmetic mean deviation, measurable by profilometry, of peaks and valleys in comparison to a predetermined average profile over a reference length or surface: such a first roughness parameter is defined precisely for a two-dimensional profile over a reference length called a "basic length" by international standard ISO 4287, referred to as Ra; it is also precisely defined for a three-dimensional profile over a basic surface called a "scale-limited surface" by international standard ISO 25178-2, referred to as Sa,
- a second roughness parameter defined as a maximum deviation measurable by profilometry between the highest of the peaks and the lowest of the valleys over a reference length or surface: such a second roughness parameter is defined precisely for a two-dimensional profile over a reference length called a "basic length" by international standard ISO 4287, referred to as Rz; it is also precisely defined for a three-dimensional profile over a basic surface called a "scale-limited surface" by international standard ISO 25178-2, referred to as Sz,
- a third roughness parameter defined as the mean squared deviation, measurable by profilometry, of peaks and valleys in relation to a predetermined average profile over a reference length or surface: such a third roughness parameter is defined precisely for a two-dimensional profile over a reference length called a "basic length" by international standard ISO 4287, referred to as Rq; it is also precisely defined for a three-dimensional profile over a basic surface called a "scale-limited surface" by international standard ISO 25178-2, referred to as Sq,
- a fourth roughness parameter defined as a density of peaks, that is, as a number of peaks per unit of surface, measurable by profilometry, over all or a portion of the external specific surface S of conductor 10: such a fourth roughness parameter is defined precisely for a three-dimensional profile by international standard ISO 25178-2, referred to as Spd,
- a fifth roughness parameter defined as the arithmetic mean of the curvature radii of peaks within a defined zone, said mean being measurable by profilometry over all or a portion of the external specific surface S of conductor 10: such a fifth roughness parameter is defined precisely for a three-dimensional profile by international standard ISO 25178-2, referred to as Spc; in particular, it may be defined over the basic surface referred to as the "scale-limited surface" of this standard.

The first three parameters are height amplitude parameters which can be expressed in the form of mathematical expressions. Consequently, by notating $l_{ref}$ as the basic length according to standard ISO 4287, $A_{ref}$ as the area of the scale-limited surface according to standard ISO 25178-2, z(x) or z(x,y) as the height of the two-dimensional or three-dimensional profile under consideration at a point, we have:

$$R_a = \frac{1}{l_{ref}} \cdot \int_0^{l_{ref}} |z(x)|dx,$$

$$S_a = \frac{1}{A_{ref}} \cdot \iint_{A_{ref}} |z(x, y)|dxdy,$$

$$R_z = \underset{l_{ref}}{\mathrm{Max}}(z(x)) - \underset{l_{ref}}{\mathrm{Min}}(z(x)),$$

$$S_z = \underset{A_{ref}}{\mathrm{Max}}(z(x, y)) - \underset{A_{ref}}{\mathrm{Min}}(z(x, y)),$$

$$R_q = \sqrt{\frac{1}{l_{ref}} \cdot \int_0^{l_{ref}} z^2(x)dx}\text{, and}$$

$$S_q = \sqrt{\frac{1}{A_{ref}} \cdot \iint_{A_{ref}} z^2(x, y)dxdy}\ .$$

A sixth relevant roughness parameter is defined as a Minkowski-Bouligand fractal dimension or a "box counting" dimension. This is a dimensionless parameter generally referred to as Sfd and defined very precisely, for example, in the book by Falconer entitled "Fractal geometry: mathematical foundations and applications," published by Wiley in 1990 ($1^{st}$ edition) and 2003 ($2^{nd}$ edition). It is also mentioned in appendix B of international standard ISO 25178-2. It can be measured by profilometry over all or a portion of the external specific surface S of conductor 10. It characterizes the roughness by a calculation made from the slope of the scale graph, which is in turn defined as the logarithmic graph of volumes included in the morphological envelopes obtained by closing and opening a surface considered by means of a flat structural element as a function of the logarithm of the size of that flat structural element.

According to the invention, roughness R of the external specific surface of bare conductor 10, expressed as a function of first parameter Ra or Sa, is equal to or greater than 1.9 μm, and the inside volume V of bare conductor 10 has an oxygen doping of its aluminum-based or aluminum alloy-based components to a depth of at least P=300 nm with respect to external specific surface S, at a ratio equal to or greater than 20%, preferably even greater than 30% or even 35% or more. The oxygen doping in question produces aluminum oxide, more specifically alumina with the chemical formula $Al_2O_3$. In an equivalent way, roughness R of the external specific surface of bare conductor 10, expressed as a function of third parameter Rq or Sq, is advantageously equal to or greater than 2.5 μm, preferably even within the range [2.5 μm, 25 μm], for example 3.6 μm±1.1 μm. Lastly, as an option and also advantageously, roughness R of the external specific surface of bare conductor 10, expressed as a function of second parameter Rz or Sz, is advantageously equal to or less than 42 μm.

Also in accordance with the invention, it is even more advantageous for roughness R of the external specific surface of bare conductor 10, expressed as a function of fourth parameter Spd, to be within the range [0.00014/μm$^2$, 0.0005/μm$^2$] over the entire external specific surface. Such a parameter is characteristic of the surface homogeneity of the conductor. When it is within this range [0.00014/μm$^2$, 0.0005/μm$^2$], it brings about a decrease in the noise and losses due to the corona effect.

It is also even more advantageous for roughness R of the external specific surface of bare conductor 10, expressed as a function of fifth parameter Spc, to be within the range [0.05/μm, 0.35/μm]. This parameter is important because it makes it possible to determine whether the top of a peak is pointy or not. The greater its value, the more the peak has the shape of a pointy tip, whereas the lower its value, the greater its curvature radius.

It is also even more advantageous for roughness R of the external specific surface of bare conductor 10, expressed as a function of sixth parameter Sfd of the Minkowski-Bouligand fractal dimension, to be within the range [2.44, 3].

Indeed, it has been noticed that with these properties (at least Ra or Sa equal to or greater than 1.9 μm with regard to the roughness) of high roughness and deep oxygen doping, the corona effect produced by bare conductor 10 when used for the transport of HTB high voltage electricity is very noticeably reduced, thus leading to less noise in dry or wet weather and lower line losses.

In particular, the oxygen doping introduces an electron barrier or band gap that prevents electrons from leaving conductor 10, with the alumina having, for example, a resistivity on the order of $10^{19}$ Ω·cm at 287 K, while pure aluminum and almelec have a resistivity on the order of $3\cdot10^{-9}$ Ω·m at 300 K.

As an option, it is even more advantageous for first parameter Ra or Sa expressing roughness R of bare conductor 10 to be within the range [1.9 μm, 25 μm], for example 2.8 μm±0.9 μm.

Also as an option, it is even more advantageous for second parameter Rz or Sz expressing roughness R of bare conductor 10 to be within the range [25 μm, 42 μm], for example 35.6 μm±5.9 μm.

Also as an option, it is even more advantageous for the oxygen doping of inside volume V of bare conductor 10 to vary according to a monotonic decrease in the ratio of aluminum oxide, from more than 80% to more than 20%, preferably even from more than 80% to more than 30%, or even from more than 80% to more than 35%, from external specific surface S to said depth of at least P=300 nm.

Figure 2:
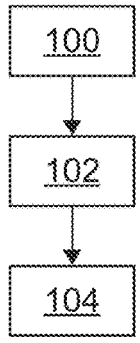
FIG. 2 illustrates the successive steps of a method for manufacturing the cable in FIG. 1, according to an embodiment of the invention.

A method for manufacturing an electric current transmission cable such as the one partially illustrated in FIG. 1 will now be described in detail in reference to FIG. 2.

During a first step 100, the cable comprising bare conductor 10 is made by wire drawing and stranding according to a well-known technology which will not be described in detail, but which makes it possible to produce a cable in compliance with the specifications of standard EN 50182, EN 50540, or EN 62219.

Next, during a spraying step 102, the external specific surface of the resulting cable is treated with sand-blasting, that is, by spraying abrasive granules containing aluminum oxide under pressure, for example abrasive granules of white or brown corundum. This can be done by having the cable travel at a certain linear speed, such as between 1 and 10 m/min, and at a certain angle, for example between 30 and 90 degrees, in front of nozzles blasting the abrasive corundum granules. By proceeding in this way, not only can the roughness of the external specific surface S of bare conductor 10 be increased to a value equal to or greater than 1.9 μm for first parameter Ra or Sa, while keeping the value of second parameter Rz or Sz equal to or less than 42 μm, but in addition a certain quantity of oxygen atoms is adsorbed at depth in the inside volume V of bare conductor 10 in keeping with the Nernst-Einstein equation, so as to dope said volume at least to a depth P of 300 nm with respect to external specific surface S, said doping consisting of an aluminum oxide content or, more generally, an oxygen content, in comparison to its aluminum-based or aluminum alloy-based components that is still equal to or greater than 20%, preferably even greater than 30% or even 35%, or more specifically decreasing from more than 80% to more than 20%, or from more than 80% to more than 30%, or from more than 80% to more than 35% from external specific surface S to said depth P.

Sand-blasting 102 is advantageously conducted in a homogeneous way over the entire external specific surface S of bare conductor 10, i.e. so as to be entirely impacted by the abrasive granules. This is confirmed by ensuring that the fourth roughness parameter Spd does indeed fall within the range [0.00014/μm$^2$, 0.0005/μm$^2$] over the entire external specific surface S of bare conductor 10.

The size of the abrasive granules of corundum is, for instance, less than 400 μm, particularly less than 250 μm (corresponding to 60 Mesh), or less than 180 μm (corresponding to 80 Mesh).

During the following optional step 104 the cable can be cleaned to remove any abrasive granules remaining on the surface after the blasting step 102.

It should be noted that the sand-blasting treatment does not noticeably alter the mechanical strength and resistivity properties (when the measurements are done with direct current) of the aluminum or aluminum alloy strands of bare conductor 10.

Figure 3A:
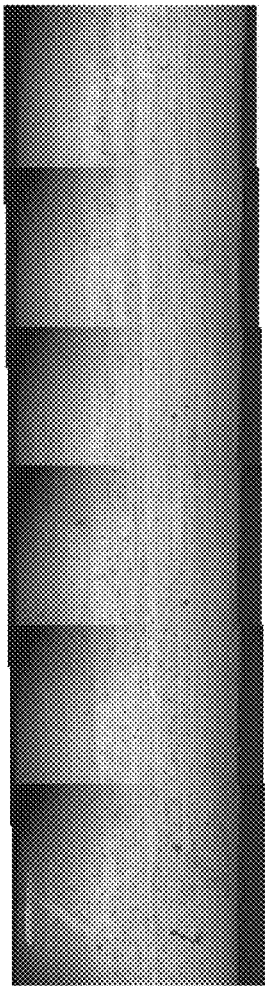
FIGS. 3A, 3B, and 3C illustrate photos of portions of cables taken before and after executing a sand-blasting step in the manufacturing method of FIG. 2, FIGS. 4A, 4B, and 4C are three-dimensional graphs illustrating roughness profiles corresponding to the cables of FIGS. 3A, 3B, and 3C, respectively.
Figure 3B:
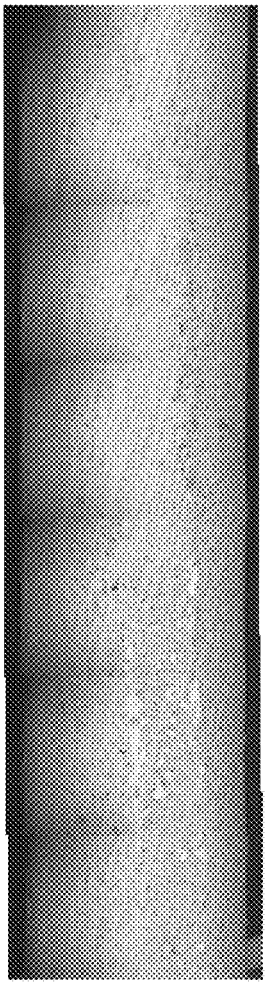
Figure 3C:
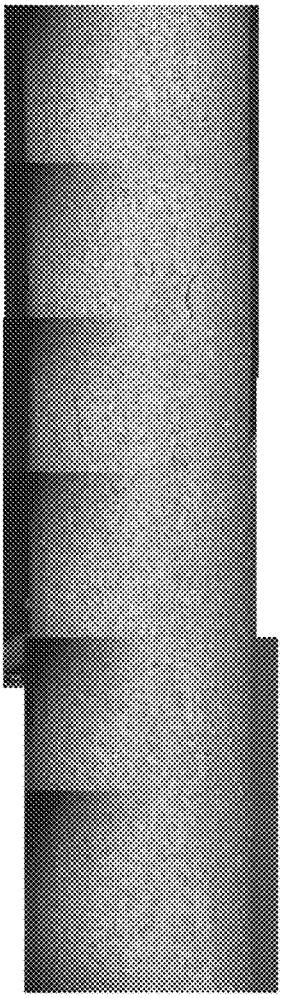

FIG. 3A provides an example of a photo taken of a portion of the external specific surface of a cable obtained after step 100 has been performed, with this photo having been taken with a scanning electron microscope. FIG. 3B is a similar photo of this same portion of the external specific surface of a cable after steps 102 and 104 have been completed, with the sand-blasting parameter settings being such that a roughness of 3 μm, expressed according to first parameter Ra or Sa, is achieved. FIG. 3C is a similar photo of this same portion of the external specific surface of a cable after steps 102 and 104 have been completed, with the sand-blasting parameter settings being such that a roughness of 8 μm, expressed according to first parameter Ra or Sa, is achieved.

Figure 4A:
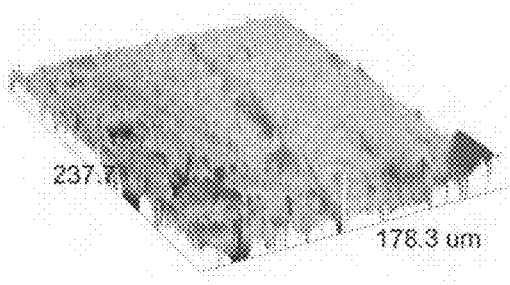
Figure 4B:
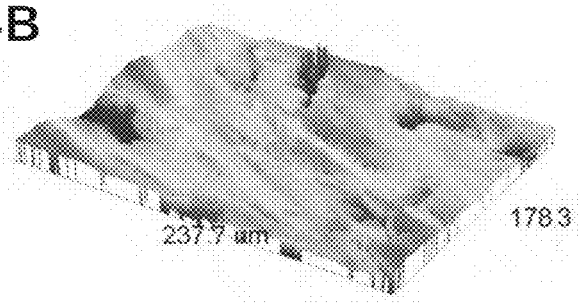
Figure 4C:
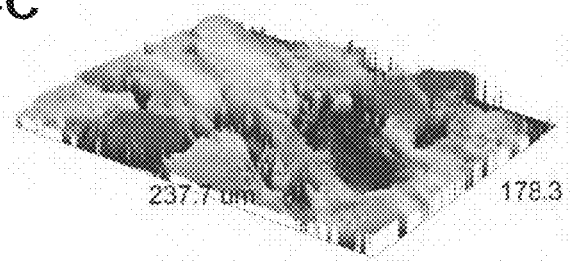
Figure 4C:
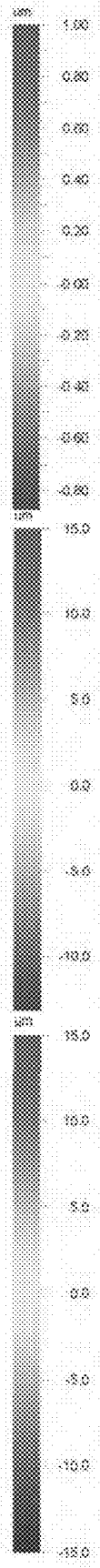

FIGS. 4A, 4B, and 4C are three-dimensional graphs illustrating the corresponding roughness profiles. In these graphs and in the photos, one can see that sand-blasting step 102 with abrasive granules makes it possible to eliminate the pointy peaks of about one nanometer that are generally formed during step 100 by wire-drawing, and to obtain an irregular surface texture. Consequently, the increased curvature of the tops of the peaks makes it possible to reduce the corona effect in dry weather. In addition, in wet weather the formation of these peaks with large curvature radii makes it possible to increase the surface energy and to spread drops of water in order to work against the pointy tips formed when they are subjected to an electric field.

Figure 5A:
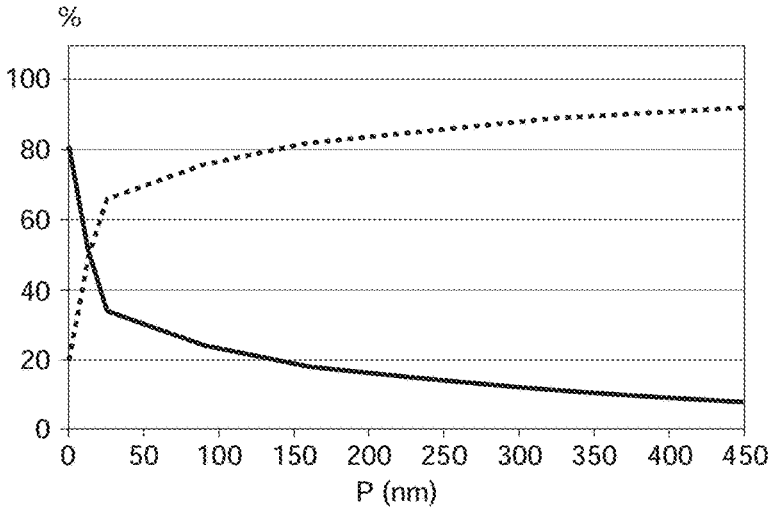
FIGS. 5A, 5B, and 5C are graphs illustrating variations of aluminum oxide ratios in the inside volume of conductors corresponding to the cables of FIGS. 3A, 3B, and 3C, respectively.
Figure 5B:
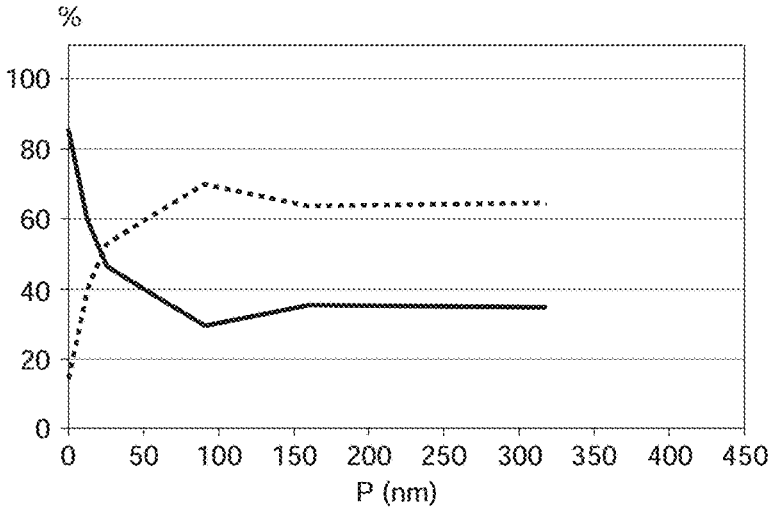
Figure 5C:
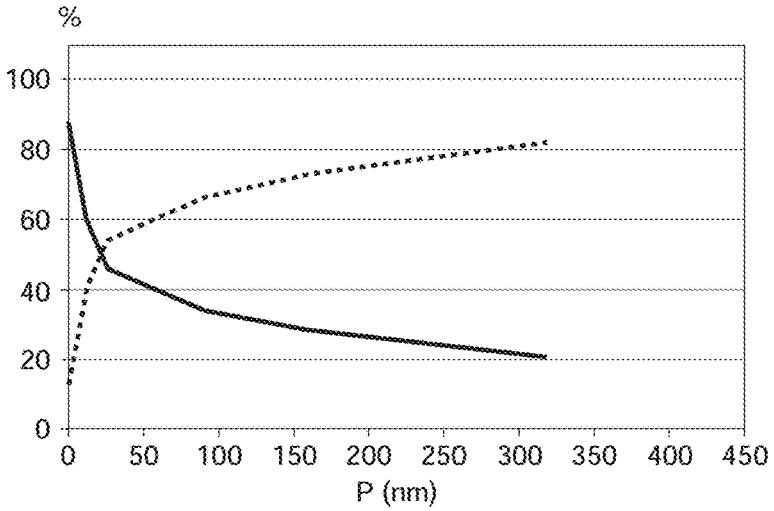

As concerns the oxygen doping, FIGS. 5A, 5B, and 5C are graphs illustrating measured aluminum oxide ratios as a function of the depth in the inside volume of conductors, corresponding to the cables of FIGS. 3A, 3B, and 3C, respectively.

In FIG. 5A, the aluminum oxide ratio shown as a solid line, which is on the order of 80% at the surface of the conductor, drops quickly below the 20% threshold at a depth of 140 nm in the inside volume of the conductor. Correspondingly, the ratio of aluminum or non-oxide aluminum alloy is shown with a dotted line.

In FIG. 5B, the aluminum oxide ratio, shown with a solid line, which is on the order of 85% at the surface of the conductor, drops less rapidly according to a monotonic decrease and remains largely above the 20% threshold and even above 30% or even 35%, beyond the depth of 300 nm in the inside volume of the conductor. Correspondingly, the ratio of aluminum or non-oxide aluminum alloy is shown with a dotted line.

In FIG. 5C, the aluminum oxide ratio shown as a solid line, which is on the order of 85% at the surface of the conductor, drops less rapidly than in FIG. 5A and remains above the 20% threshold to a depth of 300 nm in the inside volume of the conductor. Correspondingly, the ratio of aluminum or non-oxide aluminum alloy is shown with a dotted line.

For a conductor made of almelec, that is, a conductor containing aluminum, magnesium, and silicon, an equivalent doping with magnesium oxide and silicon oxide is also observed in the case of the cables in FIGS. 3B and 3C. This doping improves the protection of the bare conductor against electric current leaks.

In acoustic tests conducted on the cables corresponding to FIGS. 3B, 3C, 4B, 4C, and 5B, 5C an acoustic drop of more than 20 dBA in the noise due to the corona effect was measured in dry weather, and specifically 24 dBA with respect to a cable such as the one corresponding to FIGS. 3A, 4A, and 5A for a potential gradient of 19.8 kV/cm.

It is clear that an electric current transmission cable such as the one described above makes it possible to reduce noise disturbances and electrical losses induced by the corona effect. This is all the more remarkable in that the solution described above does not require the addition of any material or protective layer, or any reinforcement of the metal support structures, contrary to most of the known solutions for reducing the corona effect.

In addition, step 102 for sand-blasting with abrasive granules is found to give the cable a dull appearance so that its visual impact is diminished. Furthermore, this step 102 entails a low manufacturing cost for a very noticeable improvement in the resulting cable.

In addition, it should be noted that the invention is not limited to the embodiment described above. Indeed, a person skilled in the art could conceive of various modifications to the invention in light of the teaching disclosed above. In the claims which follow, the terms must not be interpreted as limiting the claims to the embodiment presented in the present description, but rather must be interpreted as including all equivalent measures that the claims are intended to cover, in light of their wording, and which can be foreseen by a person skilled in the art through the application of his/her general knowledge to the implementation of the teaching disclosed above.

The invention claimed is:

1. An electric current transmission cable comprising:

a non-anodized bare conductor based on aluminum or an aluminum alloy, having a hydrophilic external specific surface configured to be in contact with the atmospheric environment, and an inside volume intended to conduct an electric current, wherein the external specific surface of the bare conductor has a first roughness parameter, defined as the arithmetic mean deviation, measurable by profilometry, of peaks and valleys in comparison to a predetermined average profile over a reference length or surface, equal to or greater than 1.9 μm, and the inside volume of the bare conductor has oxygen doping of its aluminum-based or aluminum alloy-based components at a ratio equal to or greater than 20%, to a depth of at least 300 nm with respect to the external specific surface.

2. The electric current transmission cable according to claim 1, wherein the first roughness parameter is more precisely within the range [1.9 μm, 25 μm], for example 2.8 μm±0.9 μm.

3. The electric current transmission cable according to claim 2, wherein the external specific surface of the bare conductor has another roughness parameter, defined as the mean squared deviation, measurable by profilometry, of peaks and valleys in comparison to a predetermined average profile over a reference length or surface, equal to or greater than 2.5 μm, particularly within the range [2.5 μm, 25 μm], for example 3.6 μm±1.1 μm.

4. The electric current transmission cable according to claim 1, wherein the doping of the inside volume varies according to a monotonic decrease in the aluminum oxide ratio from more than 80% to more than 20%, from the external specific surface to said depth of at least 300 nm.

5. The electric current transmission cable according to claim 4, wherein the external specific surface of the bare conductor has a second roughness parameter, defined as the maximum deviation, measurable by profilometry, between the highest peak and the lowest valley over a reference length or surface, equal to or less than 42 μm, particularly within the range [25 μm, 42 μm], for example 35.6 μm±5.9 μm.

6. The electric current transmission cable according to claim 4, wherein the external specific surface of the bare conductor has another roughness parameter, defined as the mean squared deviation, measurable by profilometry, of peaks and valleys in comparison to a predetermined average profile over a reference length or surface, equal to or greater than 2.5 μm, particularly within the range [2.5 μm, 25 μm], for example 3.6 μm±1.1 μm.

7. The electric current transmission cable according to claim 1, wherein the external specific surface of the bare conductor has a second roughness parameter, defined as the maximum deviation, measurable by profilometry, between the highest peak and the lowest valley over a reference length or surface, equal to or less than 42 μm, particularly within the range [25 μm, 42 μm], for example 35.6 μm±5.9 μm.

8. The electric current transmission cable according to claim 7, wherein the external specific surface of the bare conductor has another roughness parameter, defined as the mean squared deviation, measurable by profilometry, of peaks and valleys in comparison to a predetermined average profile over a reference length or surface, equal to or greater than 2.5 μm, particularly within the range [2.5 μm, 25 μm], for example 3.6 μm±1.1 μm.

9. The electric current transmission cable according to claim 1, wherein the external specific surface of the bare conductor has another roughness parameter, defined as the mean squared deviation, measurable by profilometry, of peaks and valleys in comparison to a predetermined average profile over a reference length or surface, equal to or greater than 2.5 μm, particularly within the range [2.5 μm, 25 μm], for example 3.6 μm±1.1 μm.

10. The electric current transmission cable according to claim 1, wherein the external specific surface of the bare conductor has another roughness parameter, defined as the density of peaks, measurable by profilometry, over a reference surface, falling within the range [0.00014/μm2, 0.0005/μm2].

11. The electric current transmission cable according to claim 1, wherein the external specific surface of the bare conductor has another roughness parameter, defined as the arithmetic mean of the curvature radii of peaks, said mean being measurable by profilometry over a reference surface, falling within the range [0.05/μm, 0.35/μm].

12. The electric current transmission cable according to claim 1, wherein the external specific surface of the bare conductor has another roughness parameter, defined as the Minkowski-Bouligand fractal dimension, measurable by profilometry, over a reference surface, falling within the range [2.44, 3].

13. The electric current transmission cable according to claim 1, wherein the bare conductor comprises a plurality of aluminum or aluminum alloy strands twisted together in concentric layers of alternating directions around a strand forming the longitudinal axis of the cable, said strands having cross-sections of predetermined shapes.

14. The electric current transmission cable of claim 13, wherein the predetermined shapes comprise circular, trapezoidal, or "Z" cross-sections.

15. The electric current transmission cable according to claim 1, wherein the bare conductor is one of made of aluminum, magnesium, and silicon alloy, namely almelec, made of aluminum and zirconium alloy, and made of annealed aluminum.

16. The electric current transmission cable according to claim 1, wherein the electric current transmission cable is configured to be installed overhead and on pylons for the transmission of a high-voltage electric current that is one of an alternating current greater than 50 kV and a direct current greater than 75 kV.

17. The electric current transmission cable according to claim 2, wherein the external specific surface of the bare conductor has a second roughness parameter, defined as the maximum deviation, measurable by profilometry, between the highest peak and the lowest valley over a reference length or surface, equal to or less than 42 μm, particularly within the range [25 μm, 42 μm], for example 35.6 μm±5.9 μm.

18. A method for manufacturing an electric current transmission cable including a non-anodized bare conductor based on aluminum or an aluminum alloy having a hydrophilic external specific surface configured to be in contact with the atmospheric environment, and an inside volume configured to conduct an electric current, said method comprising:

sand-blasting abrasive granules against the external specific surface of the bare conductor, the sand-blasting being conducted using abrasive granules comprising aluminum oxide to:

increase a first roughness parameter of the external specific surface of the bare conductor, said first roughness parameter being defined as the arithmetic mean deviation, measurable by profilometry, of peaks and valleys in comparison to a predetermined average profile over a reference length or surface, up to a value equal to or greater than 1.9 μm, and dope the inside volume of the bare conductor through the adsorption of oxygen atoms coming from the blasted abrasive granules so that said inside volume has an oxygen doping of its aluminum-based or aluminum alloy-based components at a ratio equal to or greater than 20%, to a depth of at least 300 nm with respect to the external specific surface.

19. The method for manufacturing an electric current transmission cable according to claim 18, wherein the sand-blasting is done with abrasive granules of corundum.

20. The electric current transmission cable according to claim 2, wherein the doping of the inside volume varies according to a monotonic decrease in the aluminum oxide ratio from more than 80% to more than 20%, from the external specific surface to said depth of at least 300 nm.

* * * * *